US005398990A

United States Patent [19]

Watts et al.

[11] Patent Number: 5,398,990

[45] Date of Patent: * Mar. 21, 1995

[54] CONVERTIBLE BENCH/TABLE APPARATUS

[76] Inventors: Stephen P. Watts, 1131 E. 350 North, Orem, Utah 84057; M. Brent Norton, 1303 N. Lakeview Dr., Provo, Utah 84604

[ * ] Notice: The portion of the term of this patent subsequent to Mar. 8, 2011 has been disclaimed.

[21] Appl. No.: 207,940

[22] Filed: Mar. 8, 1994

Related U.S. Application Data

[63] Continuation of Ser. No. 937,473, Aug. 28, 1992, Pat. No. 5,292,172.

[51] Int. Cl.[6] ..... A47B 85/06

[52] U.S. Cl. ..... 297/127

[58] Field of Search ..... 297/127, 125, 126, 124, 297/157

[56] References Cited

U.S. PATENT DOCUMENTS

| | | | |
|---|---|---|---|
| 1,532,417 | 4/1925 | Letts | 297/121 |
| 1,757,960 | 5/1930 | Greenstreet | 297/124 |
| 1,890,129 | 12/1932 | Ross | 155/43 |
| 2,481,935 | 9/1949 | Larson | 155/43 |
| 2,506,852 | 5/1950 | Barcus | 155/43 |
| 2,645,273 | 7/1953 | Culbertson et al. | 297/127 |
| 2,820,507 | 1/1958 | Provencher | 297/126 |
| 2,856,985 | 10/1958 | Lepper | 155/124 |
| 2,882,957 | 4/1959 | Anderson | 155/43 |
| 2,922,463 | 1/1960 | Johnston | 155/43 |
| 2,959,209 | 11/1960 | Lakin | 155/43 |
| 4,615,559 | 10/1986 | Blondeau | 297/124 |

OTHER PUBLICATIONS

"Easy Projects to Build & Finish," *Weekend Woodcrafts*, pp. 8–11, Issue 10, Aug. 1993.

*Primary Examiner*—Alexander Grosz

*Attorney, Agent, or Firm*—Berne S. Broadbent; Gary D. E. Pierce

[57] ABSTRACT

A convertible bench/table apparatus in one embodiment of the present invention as including a seat member, a means for supporting the seat member, and a backrest/tabletop member. Connected to the means for supporting the seat member is an armrest assembly that provides structural support to the backrest/tabletop when the convertible bench/table is pivoted from the bench position into the picnic table position. A hinge means accommodates for the pivotal movement of the convertible bench/table into either the first or second position, and is rigidly attached to the armrest assembly and the seat member providing a point of rotation thereon.

19 Claims, 2 Drawing Sheets

CONVERTIBLE BENCH/TABLE APPARATUS

This application is a continuation of application Ser. No. 07/937,473, filed on Aug. 28,1992 for CONVERTIBLE BENCH/TABLE APPARATUS, now U.S. Pat. No. 5,292,172.

BACKGROUND

1. The Field of the Invention

This invention relates to recreational furniture, and more particularly, to a novel convertible bench/table apparatus that conveniently transforms a bench structure into a picnic table by novel means incorporating a hinged armrest assembly that facilitates the conformation change when the backrest is lifted and pivoted to its side exposing a tabletop for dining.

2. The Background Art

Persons owning homes are common consumers of recreational patio and pool furniture. In most instances, homeowners purchase patio and pool furniture for the convenience and comfort they provide when leisurely relaxing outside or near the pool. Consumers of recreational furniture usually have an interest in the aesthetic beauty of a piece of patio or pool furniture and intend such furnishings to enhance the settings of their homes and to add decoration to their pool areas.

Benches have traditionally provided persons with a place to sit and relax outside in the yard, on the porch or near the pool. Many homeowners purchase lawn benches made of natural woods and finish them with a weather protecting varnish to ensure the longevity of the bench against the elements of nature. Although lawn benches have traditionally provided a means of sitting and relaxing in an outdoor setting, when it comes time to eat, no outdoor tabletop is available for supporting plates or the food to be eaten.

Many homeowners will accordingly purchase picnic tables as an appropriate means for placing food thereon and providing seating therearound for the people eating. If a mere surface is needed for putting the food to be eaten on and a bench for seating for those persons eating, then a picnic table suffices. However when the meal is completed, the bench associated with the picnic table no longer provides any advantage to those individuals seeking to relax and enjoy the outdoor setting. The only option of comfort while sitting on such a bench is to lean forward and rest your elbows on the tabletop. Although a picnic table provides a great function while eating outdoors, when it comes time to relax and enjoy the pleasant outdoor weather while communicating with family or friends, a park bench would provide a more comfortable piece of lawn furniture.

In view of the foregoing, a number of attempts have been made in the past to manufacture a convertible bench/table structure providing a bench with a seat and backrest in one position, to be further transformed into a seat with a tabletop structure, analogous to a picnic table, in a second position. Although the prior art combination bench and picnic tables afford significant advantages over the use of a separate table and benches or chairs, significant disadvantages remain.

For example, consumers generally desire a combination bench and table with a simple and easy means of converting the seat and backrest of the bench into the picnic table formation. Unfortunately, however, the prior art typically employs complicated mechanical laches and multiple pivotal points to accomplish a conformational transformation of the bench into a picnic table for dining. Likewise, the components of the prior art rely upon multiple working parts, a great number of nut and bolt assemblies and an array of pivotal joints to construct the final working unit. Because of the numerous mechanical parts in the prior art, production and manufacturing costs are proportionately increased and ultimately passed on to the consumer.

In addition, the multiplicity of the above-mentioned working parts in the prior art, the arrangement of the various nut and bolt assemblies, and the array of pivotal joints in the final construction of the bench/table assembly, present the consumer with a frustrating assembly process. In most situations, the consumer ends up trying to read and interpret lengthy and somewhat complicated instructions to assemble a working design for use.

Another disadvantage to the prior art combination table and bench is the difficult and sometimes awkward means of converting the bench into the picnic table conformation. In some instances, not only do pivotal pins have to be adjusted or frame members slidably modified in their adjacent slots, but with many known prior art devices, the repositioning of the backrest into the tabletop requires more than one individual to accomplish.

Considering all these factors, the prior art demands that consumers sacrifice a lengthy investment of time in assembling their final working units. And with the great numbers of mechanical working parts to assemble, the process of home construction is intensified forcing consumers to wade through in-depth and sometimes over technical instructions to attain any use from their so-called recreational furniture.

BRIEF SUMMARY AND OBJECTS OF THE INVENTION

In view of the foregoing, it is a primary object of the present invention to provide a new and improved functional and structural design for convertible bench/tables.

Another object of the present invention is to provide an aesthetically pleasing piece of recreational furniture made of natural redwood construction for finishing with an outdoor ultraviolet weather resistant stain to preserve the wood's beauty.

An additional object of the present invention is to provide a reduction in the number of mechanical working parts that will effect a decrease in the overall manufacturing and production costs of a convertible bench/table.

Further, it is an object of the present invention to provide a convertible bench/table that is easy to assemble.

It is a still further object of the present invention to provide a simpler and less awkward means for converting the bench into its picnic table formation.

Consistent with the foregoing objects, and in accordance with the invention as embodied and broadly described herein, a convertible bench/table apparatus is disclosed in one embodiment of the present invention as including a seat member, a means for supporting the seat member, and a backrest/tabletop member.

Connected to the means for supporting the seat member is a novel armrest assembly that provides structural support to the backrest/tabletop when the convertible bench/table is pivoted from the bench position into the picnic table position. A hinge means accommodates for the pivotal movement of the convertible bench/table into either the first or second position, and is rigidly attached to the armrest assembly and the seat member providing a point of rotation thereon.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 4, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 2:
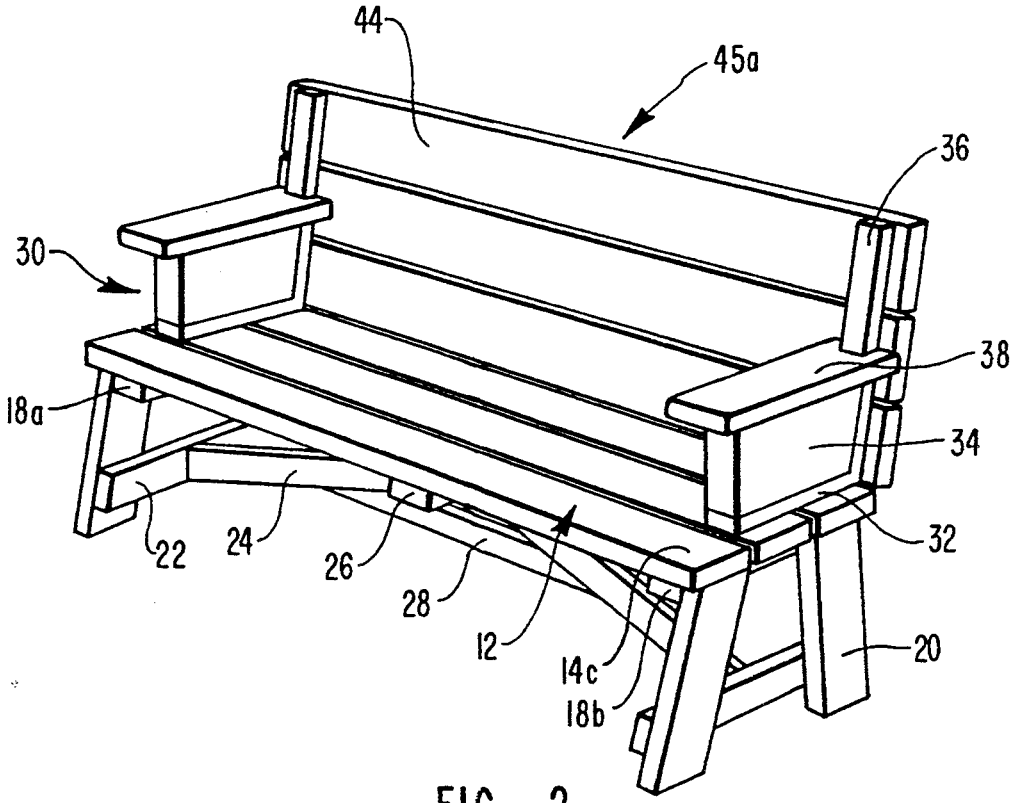
FIG. 2 is a perspective view illustrating one presently preferred embodiment of the convertible bench/table apparatus of the present invention, the apparatus being shown in a bench formation.

FIG. 2 illustrates that the preferred embodiment of the convertible bench/table apparatus 10 includes a seat comprised of longitudinal seat boards 14*a*, 14*b*, 14*c* positioned above a support frame 16. The longitudinal seat boards 14*a*, 14*b*, 14*c* extend horizontally above and across the support frame 16 and are fixed to seat supports 18*a*, 18*b* at each end by multiple screws (or bolts).

Beneath the seat supports 18*a*, 18*b* are positioned a plurality of seat support legs 20. The seat support legs 20 are composed of a sturdy wood with relative thickness and durability for reinforcing the seat 12 and weight applied thereon. The seat support legs 20 vertically engage the seat supports 18*a*, 18*b* at a slight inward angle from the base of each respective seat support leg 20. The height of the seat 12 is determinative from the vertical length and height of the seat support legs 20 when positioned under the support frame The seat supports 18 are then mounted and secured to the seat support legs 20 by multiple screws (or bolts).

A cross-sectional support means 22 connects the two seat support legs 20 found on one side of the frame 16. The cross-sectional support means 22 horizontally engages the inner side of two seat support legs 20 at a position close to the base of each support leg. The cross-sectional support means 22 is rigidly attached to each support leg 20 by multiple screws (or bolts).

Two seat cross-braces 24, preferably made of wood, extend from the cross-sectional support means 22 upwardly at a 30–35 degree angle to meet a midsection seat brace 26 positioned half-way between the seat supports 18. The proximal end 23 of each seat cross-brace 24 is rigidly connected to the adjoining cross-sectional support means 22 by multiple screws (or bolts) being passed through the seat cross-braces 24 and further introduced into the adjoining cross-sectional support means 22. The distal end 25 of each upward extending seat cross-brace 24 engages the underside of the midsection seat brace 26. The association between the seat cross-braces 24 and the midsection seat brace 26 involves a means for rigidly attaching the seat cross-braces to the underside of the midsection seat brace. Fastened to the upside of the midsection seat brace 26 are the longitudinal seat boards 14*a*, 14*b*, 14*c* of the seat 12.

A horizontal reinforcement slat 28 lies underneath and parallel to the seat 12 and is connected to the adjacent seat cross-braces 24. The opposing ends of the reinforcement slat 28 are respectively secured at a midpoint on the adjacent seat cross-brace 24 by passing screws through the end of each horizontal reinforcement slat 28 and into the adjoining seat cross-brace 24. The horizontal reinforcement slat 28 provides overall structural integrity to the support frame 16 of the convertible bench/table 10 and the seat 12, to counteract the depression of forces exercised thereupon.

Figure 1:
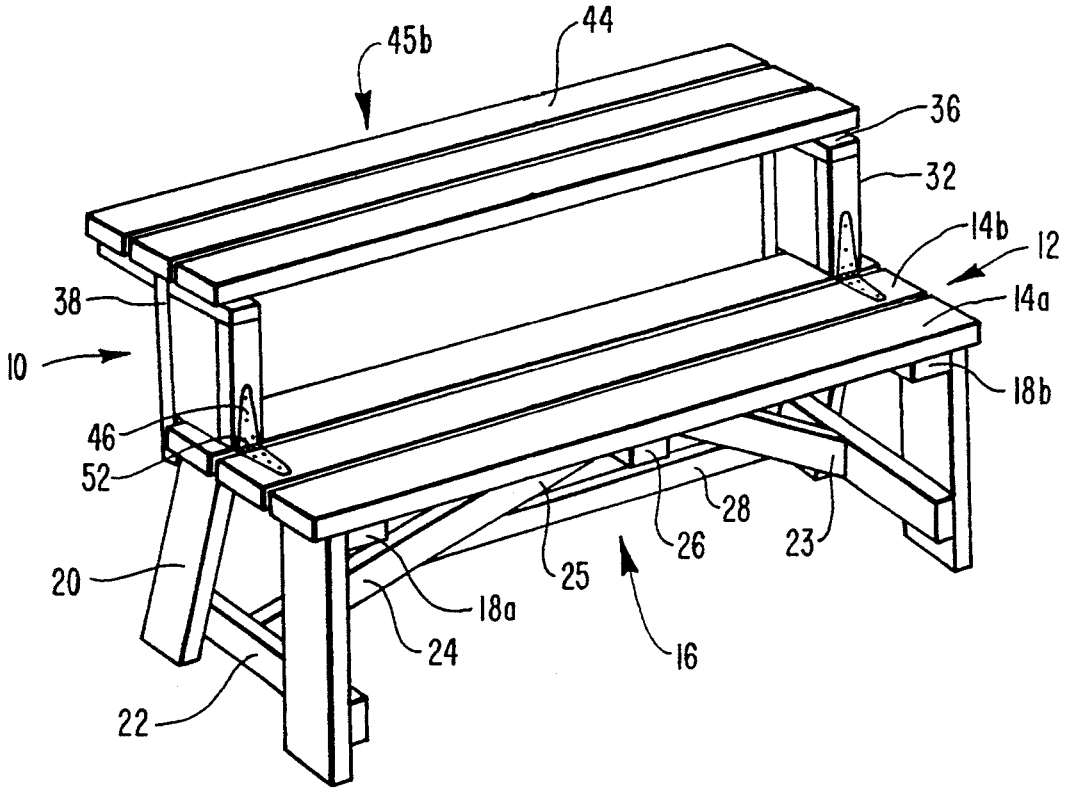
FIG. 1 is a perspective view illustrating one presently preferred embodiment of the convertible bench/table apparatus of the present invention, the apparatus being shown in a tabletop position.

Resting upon the support frame 16 in a second position as represented in FIG. 2 are two armrests 30. In its presently preferred embodiment, each armrest 30 is composed of a four piece assembly, comprising: (1) a base board 32; (2) a second member 34, rectangular in shape and comprising a majority of the body of the armrest 30, where the height of the second member 34 directly relates to the height consistency of the tabletop 45*b* when the convertible bench/table is in its first position as represented in FIG. 1; (*3*) a lateral extension 38 resting on top of the second member 34 and extending transversely a greater length than the base board 32 and the second member 34, and (4) a backboard member 36 that extends upwardly and is interposed along the backside of the horizontal base board 32, the second member 34 and the lateral extension 38 and is rigidly attached thereto by a multiple of screws (or bolts). The combination of the base board 32, the second member 34, the backboard member 36, and the lateral extension 38 comprises the armrest assembly 30 and each member thereof is affixed to each other by a means of furniture glue or multiple screws (or bolts).

Attached to the backside of the backboard member 36 of the armrest assembly 30 are longitudinal boards 44. These longitudinal boards 44 are mounted to the backboard member 36 by a multiple of screws (or bolts) and form a backrest/tabletop 45. When the convertible bench/table 10 is in its second position as represented by FIG. 2, the backboard member 36 lies in a upright position providing a backrest 45*a* for the seat 12 and exposing a bench for sitting and relaxing, while the body of the armrest assembly 30 lies substantially horizontal. When the convertible bench/table be is in its first position as represented by FIG. 1, the backboard member 36 lies substantially horizontal exhibiting a tabletop 45*b* and providing a table for a picnic, while the body of the armrest assembly 30 rests on its side in an upright position.

Figure 4:
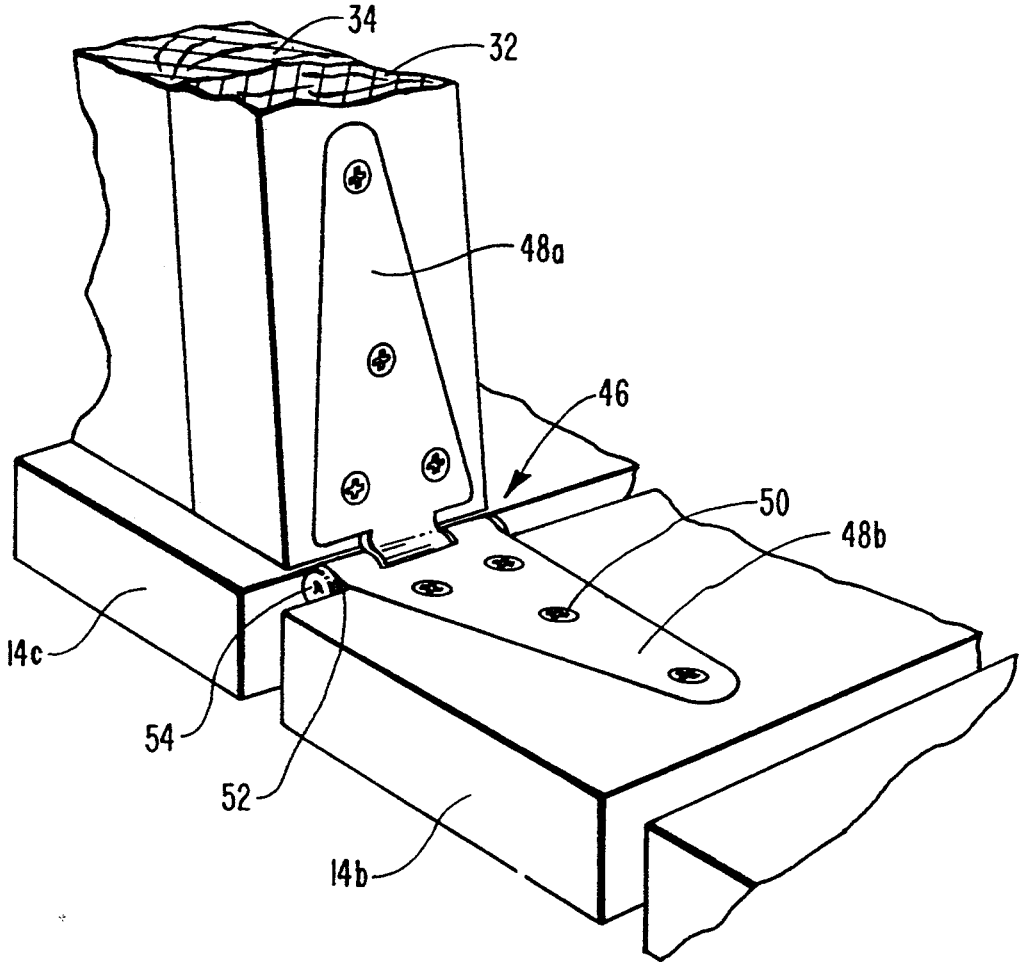
FIG. 4 is an enlarged perspective view taken along lines 4—4 of FIG. 3 showing the hinge mechanism of the armrest assembly which provides the pivotal motion in transforming the convertible bench/table apparatus from the first position to the second position.

As represented by FIG. 4, affixed to the underside of the base board 32 of the armrest assembly 30 is a hinge bracket arm 48*a* that allows the armrest assembly to be pivoted from a horizontal position into a vertical position, where the bench/tabletop 45 is transformed from a bench into a picnic table. The second arm of the hinge bracket 48*b* is rigidly attached to the longitudinal seat board 14*b*. The intimacy of these connections is achieved by a means comprising a multiple of openings 50 in each arm 48 of the hinge bracket 46 in which screws can be interposed therethrough into the base board 32 with a slight introduction into the second member 34 of the armrest 30.

The introduction of the screws through the openings 50 in the arms of the hinge brackets 48 and further fed into the body of the armrest 30 and the longitudinal seat board 14*b*, conforms to a stable fastening where a pivotal means can be established therefrom. Located medially between the two bracket arms 48*a*, 48*b* of the hinge bracket 46, is an aperture 52 whereby a suitable hinge pin 54 is inserted to accommodate the pivotal motion of the convertible backrest/tabletop 10 from its first position as represented in FIG. 1, to the second position as represented in FIG. 2, or vice versa. The aperture 52, encasing the hinge pin 54, is positioned between the two hinge bracket arms 48*a*, 48*b* in such a way that when the convertible bench/table 10 is pivoted around the medial axis of the hinge bracket 46, the backrest 45*a* becomes a suitable tabletop 45*b* supported by the armrest assembly 30.

The base board 32 and the second member 34 of the armrest assembly 30 facilitate a surface abutment against the seat 12 acting as a first structural stop 40 when the convertible bench/table is in a table formation as depicted in FIG. 1. The first structural stop 40 provides structural integrity to the tabletop 45*b* and those forces applied thereupon.

The lateral extensions 38 of the armrest assembly 30 provide a surface abutment against the longitudinal seat board 14(*c*) equalizing a second structural stop 42 for support of the tabletop 45*b* when the convertible bench/table 10 is in the first position as represented in FIG. 1. The portion of the lateral extensions 38 of the armrest assembly that extends beyond the body of the armrest 30, becomes substantially vertically displaced when the convertible bench/table 10 is pivoted at the hinge bracket 46. Upon the substantial vertical displacement, the lateral extensions 38 abut the forward seat support legs 20 and the front side of the longitudinal seat board 14*c*, exerting a restriction on any further forward pivoting movement on the part of the backrest/tabletop 45, conforming to the second structural support stop 42.

When the preferred embodiment of the present invention is in its second position as shown in FIG. 2, the convertible bench/table 10 conforms to a suitable bench with a seat backrest 45*a* and two armrests 30 providing additional comfort to those persons relaxing thereupon. The convertible bench/table is preferably constructed of 100% natural redwood, although other suitable materials may be used in the construction of the convertible bench, such as other types of wood products or even a metal configuration, to accommodate the novel functional and structural elements of the present invention. Overall, the structure and design of the convertible bench/table is aesthetically pleasing to the eye and furnishes a pleasant seating or dining experience for those persons leisurely relaxing in the yard, on the porch or near the pool.

In use, if, for example, a family wants to eat out on the lawn, near the pool, or at a nearby campground, the convertible bench/table can be conveniently placed into the back of the truck for easy transportation to the campground, or quickly and easily converted into a suitable picnic table where it sits. By lifting and pivoting the backrest and both armrest on their sides accomplished by the hinge means and structural stops, the backrest transforms into a tabletop providing the surface area for a family picnic.

Figure 3:
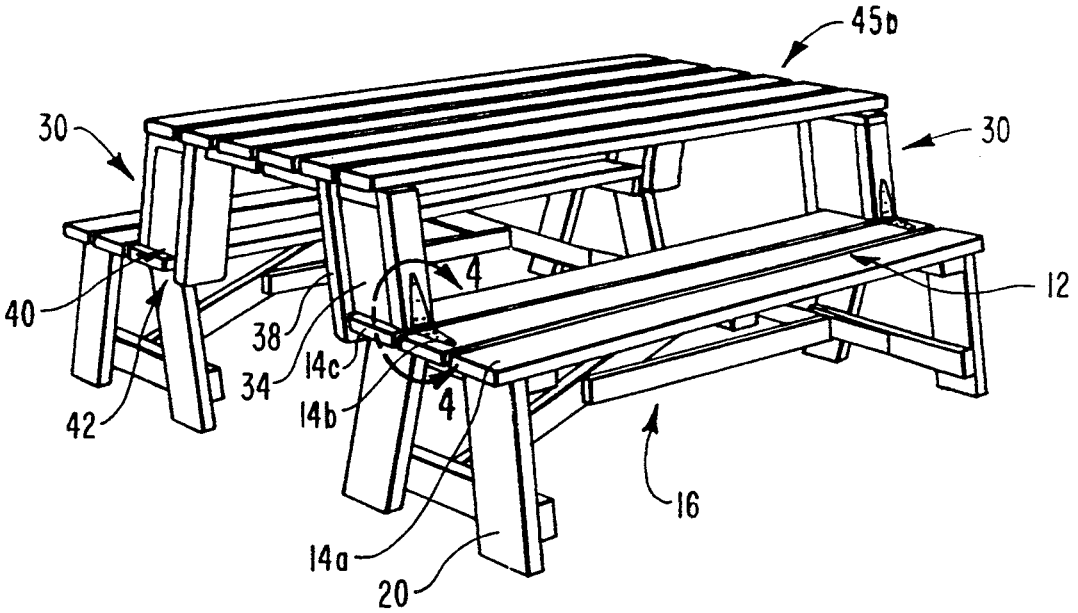
FIG. 3 is a perspective view of a convertible bench/table apparatus in accordance with the present invention being aligned with an opposing convertible bench/table apparatus to provide a larger tabletop surface, analogous to a conventional picnic table.

If a larger tabletop is required to feed family and friends, a pair of convertible bench/tables can be transformed into their tabletop formations and placed on opposite sides aligning the two tabletops together to form a larger tabletop with sturdy seats on the opposite sides thereof, as represented in FIG. 3.

From the above discussion, it will be appreciated that the present invention provides a new and improved functional and structural design for convertible bench/tables. The invention provides an aesthetically pleasing piece of recreational furniture which can be made of natural redwood construction for finishing with an outdoor ultraviolet weather resistant stain to preserve the wood's beauty. Additionally, the invention has a reduced number of mechanical working parts, as compared to prior art devices, thereby effecting a decrease in the overall manufacturing and production costs. The apparatus of the present invention is easy to assemble, and it provides a simple, easy means for converting a bench into a picnic table formation. Thus, during the inventors' experimentation, the present invention has been shown to have significant and effective advancements both functionally and structurally over the known prior art.

The present invention may be embodied in other specific forms without departing from its spirit or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by U.S. Letters Patent is:

1. A convertible bench/table apparatus (10), comprising:

a seat member (12);

a means for supporting said seat member;

a backrest/tabletop member (45);

means for pivoting the convertible bench/table apparatus (10) from a first position, exhibiting a seat (12) with an adjacent tabletop (45*b*), into a second position, exhibiting said seat (12) with a backrest (45*a*), wherein the means for pivoting the convertible bench/table apparatus (10) from said first position to said second position, and vice versa, comprises a hinge member (46);

means for structurally supporting the backrest/tabletop (45) comprising at least one structural stop (40) engaging the seat member (12), said structural stop providing means for sustaining said tabletop (45*b*) when the convertible bench/table apparatus (10) is pivoted into the first position, and wherein said means for structurally supporting said backrest/tabletop (45) comprises a hingeable engagement with said seat member when the convertible bench/table apparatus is pivoted into the second position.

2. A convertible bench/table apparatus as defined in claim 1 wherein said seat member (12) comprises at least one longitudinal seat board.

3. A convertible bench/table apparatus as defined in claim 1 wherein said means for supporting said seat member comprises a plurality of seat support legs (20) extending substantially perpendicular to said seat member (12) and displaying a suitable height.

4. A convertible bench/table apparatus as defined in claim 3 wherein said seat support legs (20) are operably connected to a cross-sectional support means (22).

5. A convertible bench/table apparatus as defined in claim 4 wherein said cross-sectional support means (22) provides a surface abutment for a first end (23) of at least two support cross-braces (24) which extend substantially upward therefrom and form a connection between a second end (25) of said support cross-braces and a midsection seat brace (26) that is rigidly attached to the seat member (12).

6. A convertible bench/table apparatus as defined in claim 5 further comprising a reinforcement slat (28) engaging said cross-braces (24) to provide structural support to said seat member (12), said reinforcement slat being positioned beneath and parallel to the seat member.

7. A convertible bench/table apparatus as defined in claim 1 wherein said backrest/tabletop member (45) comprises at least one longitudinal slat member.

8. A convertible bench/table apparatus as defined in claim 1 wherein said hinge member (46) comprises at least two extending arms (48*a*, 48*b*) and a substantially circular aperture (52) integrally formed therebetween, wherein said aperture houses a hinge pin (54) for pivoting said hinge member thereon.

9. A convertible bench/table apparatus as defined in claim 8 wherein said extending arms (48*a*, 48*b*) of the hinge member (46) are rigidly attached to the seat member (12) and means for structurally supporting the backrest/tabletop member (30) to form a hingeable connection therebetween.

10. A convertible bench/table apparatus as defined in claim 1 wherein said means for structurally supporting the backrest/tabletop member comprises an armrest assembly (30).

11. A convertible bench/table apparatus as defined in claim 10 wherein said armrest assembly (30) comprises:

a base board (32) hingeably attached to the seat member (12);

a substantially rectangular second member (34) engaging said base board (32) and comprising a majority of the body of said armrest assembly (30);

an extension member (38) formed along an upper portion of said second member (34) and extending slightly beyond the length of the second member; and a backboard member (36) rigidly connected to the backrest/tabletop member (45), said backboard member extending adjacent and in communication with the backside of said armrest assembly (30) and rigidly secured thereto.

12. A convertible bench/table apparatus as defined in claim 1 wherein said means (30) for structurally supporting said tabletop (45*b*) further comprises a second structural stop (42) for supporting the backrest/tabletop member (45) when pivoted into the first position, said second structural stop providing a surface abutment against the means for supporting said seat member.

13. A convertible bench/table apparatus as defined in claim 12 wherein said means for supporting said seat member comprises a seat support leg (20) in contiguous engagement with the means for supporting said backrest/tabletop (30) when the backrest/tabletop (45) is pivoted into the first position.

14. A convertible bench/table apparatus (10), comprising:

a seat member (12) including at least one longitudinal seat board;

a means for supporting said seat member;

a backrest/tabletop member (45);

means for pivoting the convertible bench/table apparatus from a second position, exhibiting a seat (12) with a backrest (45*a*), into a first position, exhibiting a seat (12) with an adjacent tabletop (45*b*), wherein said means for pivoting the convertible bench/table apparatus (10) from said first position to said second position, and vice versa, comprises a hinge bracket (46); and an armrest assembly (30) structurally supporting the backrest/tabletop member (45), said armrest assembly comprising at least one structural stop (40) engaging said seat member (12) when the convertible bench/table apparatus is pivoted into said first position, said armrest assembly providing a hingeable engagement between said backrest (45*a*) and said seat member when the convertible bench/table apparatus is pivoted into the second position.

15. A convertible bench/table apparatus as defined in claim 14 wherein the means for supporting said seat member further comprises:

a plurality of seat support legs (20) formed of suitable height, said support legs extending substantially downward therefrom;

a cross-sectional support means (22) operably connecting adjacent seat support legs (20);

at least two support cross-braces (24) rigidly connected to said cross-sectional support means (22) at a first end (23) and extending substantially upward therefrom forming a connection between a second end (25) of said support cross-braces and a midsection seat brace (26), said midsection seat brace being rigidly attached to said seat member (12); and a reinforcement slat (28) positioned beneath and parallel to said seat member (12), said reinforcement slat engaging said support cross-braces (24) for providing structural support thereto.

16. A convertible bench/table apparatus as defined in claim 14 wherein said hinge bracket (46) comprises at least two extending arms (48*a*, 48*b*) and a substantially circular aperture (52) integrally formed therebetween, wherein said aperture houses a hinge pin (54) for pivoting said hinge bracket thereon.

17. A convertible bench/table apparatus as defined in claim 16 wherein said extending arms (48*a*, 48*b*) of the hinge bracket (46) are rigidly attached to the armrest assembly (30) and the seat member (12) to form a hingeable connection therebetween.

18. A convertible bench/table apparatus as defined in claim 14 wherein said armrest assembly (30) comprises:

a base board (32) hingeably attached to the seat member (12);

a substantially rectangular second member (34) engaging said base board (32) and comprising a majority of the body of said armrest assembly (30);

an extension member (38) formed along an upper portion of said second member (34) and extending slightly beyond the length of said second member; and a backboard member (36) rigidly connected to the backrest/tabletop member (45), said backboard member extending adjacent and in communication with the backside of said armrest assembly (30) and rigidly secured thereto.

19. A convertible bench/table apparatus as defined in claim 14 wherein said armrest assembly (30) further comprises a second structural stop (42) for supporting the backrest/tabletop member (45) when pivoted into the first position, said second structural stop forming a surface abutment between said armrest assembly and means for supporting said seat member, wherein said means for supporting said seat member comprises at least one seat support leg (20) contiguously engaging an extension member (38) of said armrest assembly in said first position.

* * * * *

UNITED STATES PATENT AND TRADEMARK OFFICE

CERTIFICATE OF CORRECTION

PATENT NO. : 5,398,990

DATED : March 21, 1995

INVENTOR(S) : Stephen P. Watts, et al.

It is certified that error appears in the above-identified patent and that said Letters Patent is hereby corrected as shown below:

In column 3, line 51, after "seat", please insert -- 12 --.

In column 3, line 66, after "frame", please insert -- 16. --.

In column 5, line 1, please delete "be", and insert therefor -- 10 --.

In column 5, line 63, after "seat", please insert -- 12, --.

Signed and Sealed this

Thirteenth Day of June, 1995

Bruce Lehman

*Attest:*

BRUCE LEHMAN

*Attesting Officer*

*Commissioner of Patents and Trademarks*